US008807704B2

(12) United States Patent
Muraki

(10) Patent No.: US 8,807,704 B2
(45) **Date of Patent: *Aug. 19, 2014**

(54) INKJET RECORDING DEVICE HAVING WASTE LIQUID CHAMBER

(75) Inventor: Motohito Muraki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/431,132

(22) Filed: Mar. 27, 2012

(65) Prior Publication Data

US 2013/0063520 A1 Mar. 14, 2013

(30) Foreign Application Priority Data

Sep. 9, 2011 (JP) ..... 2011-197167

(51) Int. Cl.
*B41J 2/165* (2006.01)

(52) U.S. Cl.
USPC ..... 347/36

(58) Field of Classification Search
USPC ..... 347/36
See application file for complete search history.

(56) References Cited

U.S. PATENT DOCUMENTS

| | | | | |
|---|---|---|---|---|
| 6,281,911 | B1 | 8/2001 | Nakazawa et al. | |
| 7,712,891 | B2 | 5/2010 | Ishida et al. | |
| 7,784,893 | B2 | 8/2010 | Ishida et al. | |
| 2002/0118987 | A1 * | 8/2002 | Takekoshi | 399/342 |
| 2005/0151782 | A1 | 7/2005 | Ishida et al. | |
| 2005/0195241 | A1 | 9/2005 | Kawai et al. | |
| 2008/0030530 | A1 | 2/2008 | Ishida et al. | |
| 2008/0106572 | A1 | 5/2008 | Yoshino et al. | |
| 2008/0129777 | A1 | 6/2008 | Watanabe | |
| 2010/0165040 | A1 | 7/2010 | Ohnishi et al. | |

FOREIGN PATENT DOCUMENTS

| | | | |
|---|---|---|---|
| CN | 1242741 | A | 1/2000 |
| CN | 1636750 | A | 7/2005 |
| JP | 2003-289406 | A | 10/2003 |
| JP | 2003-298790 | A | 10/2003 |
| JP | 2004-188629 | A | 7/2004 |
| JP | 2006-027040 | A | 2/2006 |
| JP | 2006-035662 | A | 2/2006 |
| JP | 2006-175747 | A | 7/2006 |
| JP | 2008-137349 | A | 6/2008 |
| JP | 2009-262446 | A | 11/2009 |

OTHER PUBLICATIONS

Chinese Office Action issued in CN 201210088673.8, mailed Apr. 25, 2014.

* cited by examiner

*Primary Examiner* — Justin Seo
(74) *Attorney, Agent, or Firm* — Merchant & Gould P.C.

(57) ABSTRACT

An inkjet recording device includes a recording head, a pump, a waste liquid chamber, and a first support. The recording head has a nozzle surface formed with a nozzle from which ink droplet is ejected to form an image onto a recording medium. The pump is configured to draw ink from the recording head. The waste liquid chamber is configured to accommodate the ink drawn by the pump. The first support is configured to support the waste liquid chamber at a position above the nozzle surface.

13 Claims, 9 Drawing Sheets

24
37
38
36
TOP
LEFT
RIGHT
BOTTOM
7
9
57A
56A
56(74)
57(74)
60(74)
57(74)
58
65
66
72
111
112
113
40

INKJET RECORDING DEVICE HAVING WASTE LIQUID CHAMBER

CROSS REFERENCE TO RELATED APPLICATION

This application claims priority from Japanese Patent Application No. 2011-197167 filed Sep. 9, 2011. The entire content of this priority application is incorporated herein by reference.

TECHNICAL FIELD

The present invention relates to an inkjet recording device for recording images on a recording medium by ejecting ink droplets from a recording head, and particularly to an inkjet recording device capable of drawing ink out of the recording head through suction with a pump.

BACKGROUND

A conventional inkjet recording device known in the art records images on a recording medium by conveying the recording medium and simultaneously ejecting ink droplets onto the recording medium while the recording medium is conveyed. One such inkjet recording device is also provided with a purging mechanism that draws in ink from nozzles formed in the recording head through suction in order to remove foreign materials and the like in the nozzles together with the ink. The purging mechanism is sometimes provided with a waste liquid chamber for collecting waste ink drawn out of the nozzles.

One example of this type of inkjet recording device is a printer described in Japanese unexamined patent application publication No. 2009-262446 that includes a head serving as the recording head, a maintenance unit serving as the purging mechanism, and a waste-ink tank serving as the waste liquid chamber. In the printer disclosed in Japanese unexamined patent application publication No. 2009-262446, the waste-ink tank is disposed below and forward of the head.

The waste-ink tank must have a sufficient capacity for storing waste ink. Hence, the waste-ink tank of the printer disclosed in Japanese unexamined patent application publication No. 2009-262446 is configured to be larger than the head and the like. To make the waste-ink tank larger, the front-to-rear and left-to-right dimensions of the waste-ink tank are increased. However, increasing the size of the waste-ink tank inevitably increases the installation area of the printer.

SUMMARY

In view of the foregoing, it is an object of the invention to provide an inkjet recording device. The inkjet recording device includes a recording head, a pump, a waste liquid chamber, and a first support. The recording head has a nozzle surface formed with a nozzle from which ink droplet is ejected to form an image onto a recording medium. The pump is configured to draw ink from the recording head. The waste liquid chamber is configured to accommodate the ink drawn by the pump. The first support is configured to support the waste liquid chamber at a position above the nozzle surface.

According to another aspect, the present invention provides a multifunction device. The multifunction device includes an inkjet recording device described above, and an upper unit. The upper unit is disposed above the waste liquid chamber and has one end portion pivotally movably connected to the inkjet recording device. The waste liquid chamber has one end pivotally movably connected to the first support, and has another end. The one end portion of the upper unit is positioned closer to the one end than to the another end.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
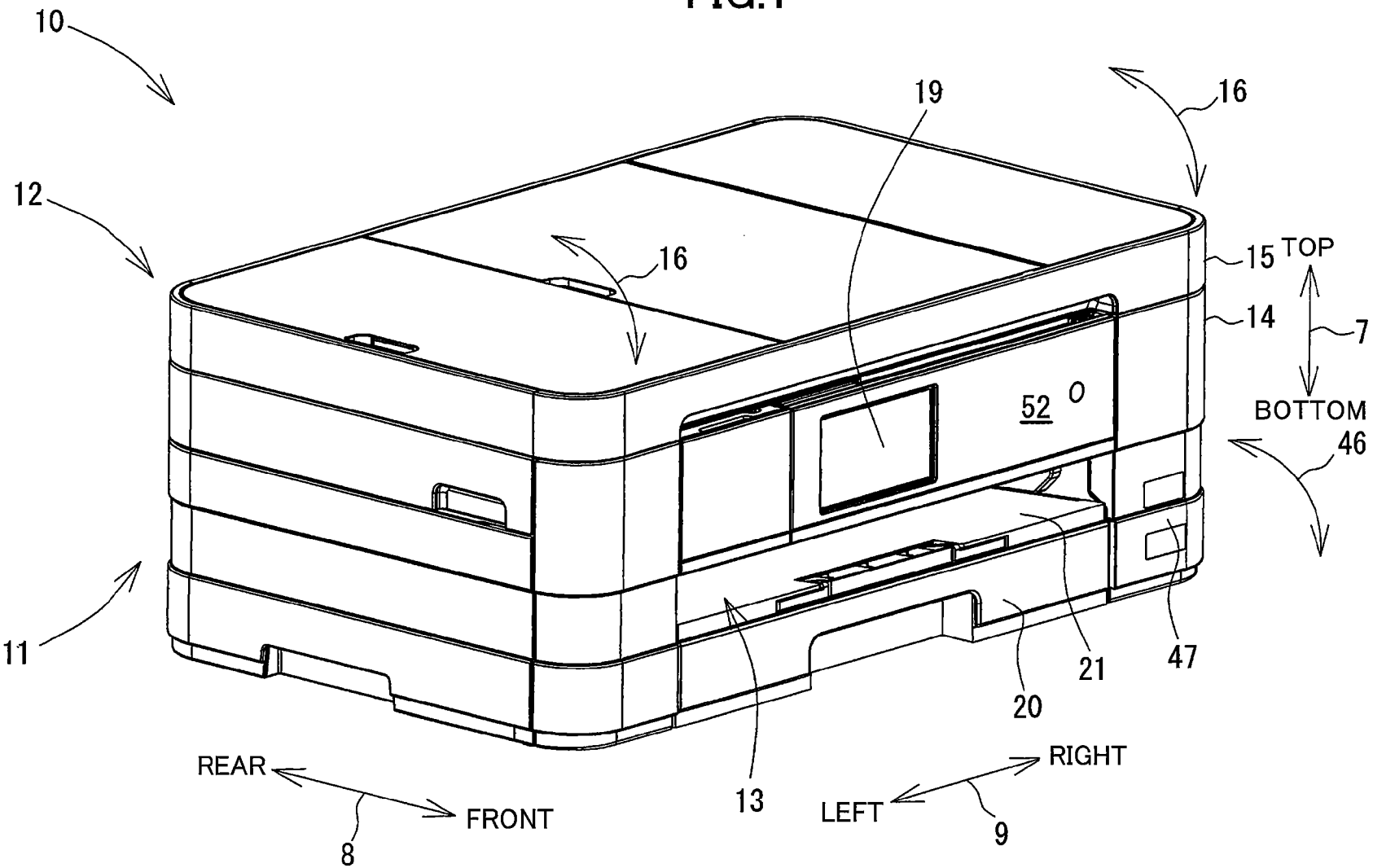
FIG. 1 is a perspective view showing an outer structure of a multifunction device according to an embodiment of the present invention.

A multifunction device 10 according to an embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the multifunction device 10 is disposed in an posture in which it is intended to be used. In use, the multifunction device is disposed as shown in FIG. 1.

[Multifunction Device 10]

As shown in FIG. 1, the multifunction device 10 is of a substantial thin rectangular parallelepiped shape. The multifunction device 10 has an upper portion provided with a scanner section 12 scanning an image on a document by an image sensor to acquire image data, and a lower portion provided with a print section 11 forming the scanned image on a recording paper. The scanner section 12 is provided with a scanner case 15 for covering an image sensor provided therein.

The print section 11 has a printer case 14. The printer case 14 has a front surface 52 formed with a device-body opening 13 and provided with a display panel 19 for displaying information. A paper tray 20 and a discharge tray 21 are also provided in the print section 11. The paper tray 20 and discharge tray 21 can be inserted into and removed from the device-body opening 13 in the front-rear direction 8. The paper tray 20 holds the recording paper of a desired size.

The scanner section 12 is configured as a flatbed scanner. The scanner case 15 is supported on the printer case 14 so that the front side of the scanner case 15 is pivotally movable about an edge portion on the rear side thereof (i.e., in a direction indicated by an arrow 16 in FIG. 1). The structure of the scanner section 12 will not be described in detail herein.

The print section 11 includes a conveying path 23 (see FIGS. 2 and 3) constituting a path inside the print section 11 along which recording paper is conveyed; a feeding roller (not shown) for supplying sheets of recording paper accommodated in the paper tray 20 into the conveying path 23; at least one pair of rollers (not shown) provided along the conveying path 23 for conveying sheets of recording paper fed into the conveying path 23 by the feeding roller; and a recording unit 24 (see FIGS. 2 and 3) configured with an inkjet recording system for recording images on recording paper based on image data read from an original by the scanner section 12 or the like.

The multifunction device 10 includes a cover body (not shown) formed below the scanner section 12 for separating the print section 11 and scanner section 12. The cover body covers the top side of the print section 11. By providing the cover body, the internal structure of the print section 11 (the recording unit 24, a waste liquid chamber 71 described later, and the like) are not exposed when the scanner section 12 is rotated upward.

[Conveying Path 23]

Figure 3:
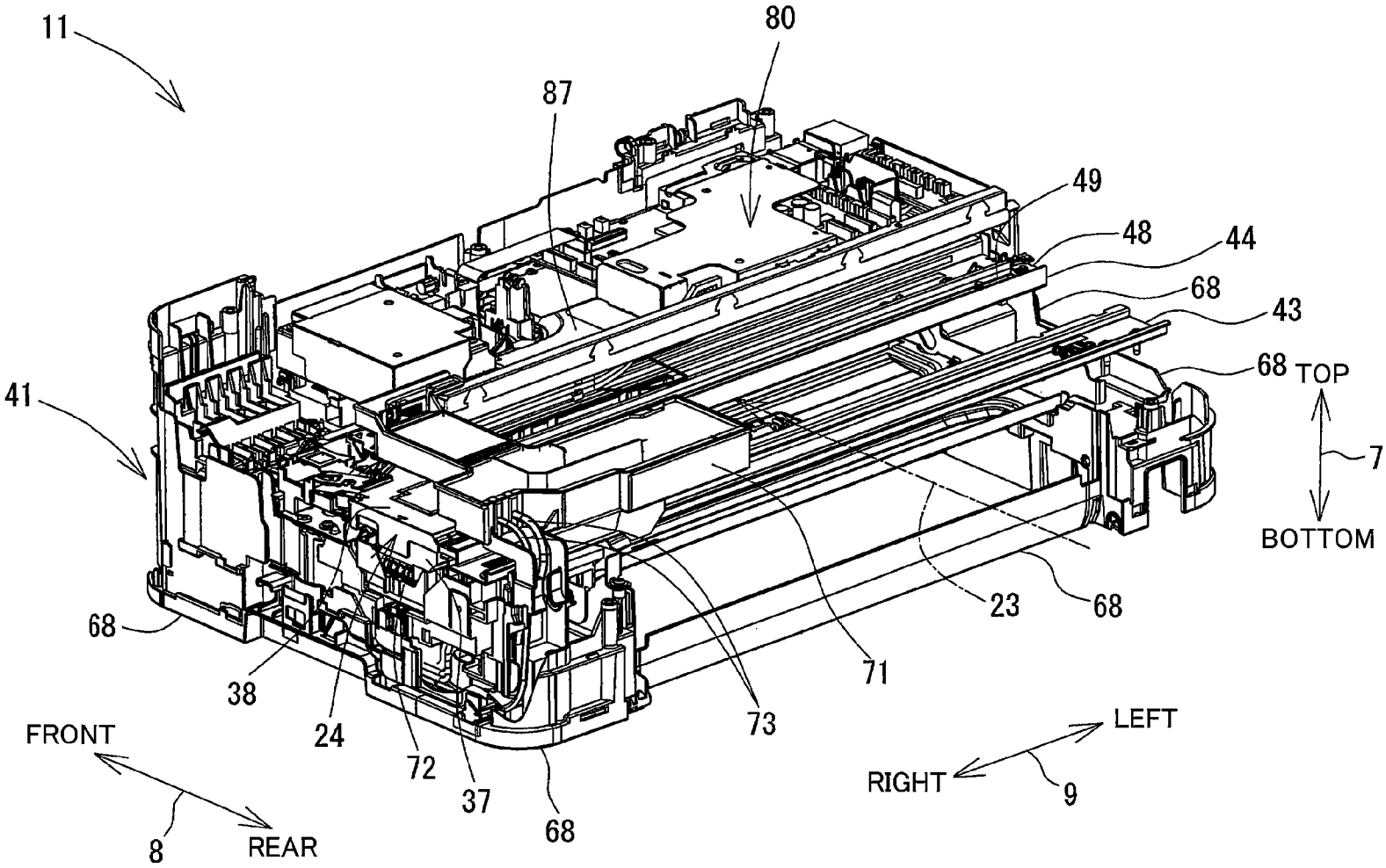
FIG. 3 is a perspective view showing the inner structure as viewed from upward rightward, and rearward.

Beginning from a base point at the rear end of the paper tray 20, the conveying path 23 extends first upward, then forward, leading to the discharge tray 21 while passing beneath the recording unit 24. The conveying path 23 is a space defined by two guide members (not shown) that oppose each other but are separated by a prescribed distance. FIG. 3 illustrates the portion of the conveying path 23 that passes beneath the recording unit 24.

[Pairs of Rollers]

Each pair of rollers disposed along the conveying path 23 for conveying sheets of recording paper includes an upper roller disposed in the top of the conveying path 23 and a lower roller disposed in the bottom of the conveying path 23 in confrontation with the upper roller. The pairs of rollers grip the recording paper and convey the recording paper along the conveying path 23.

[Recording Unit 24]

Figure 2:
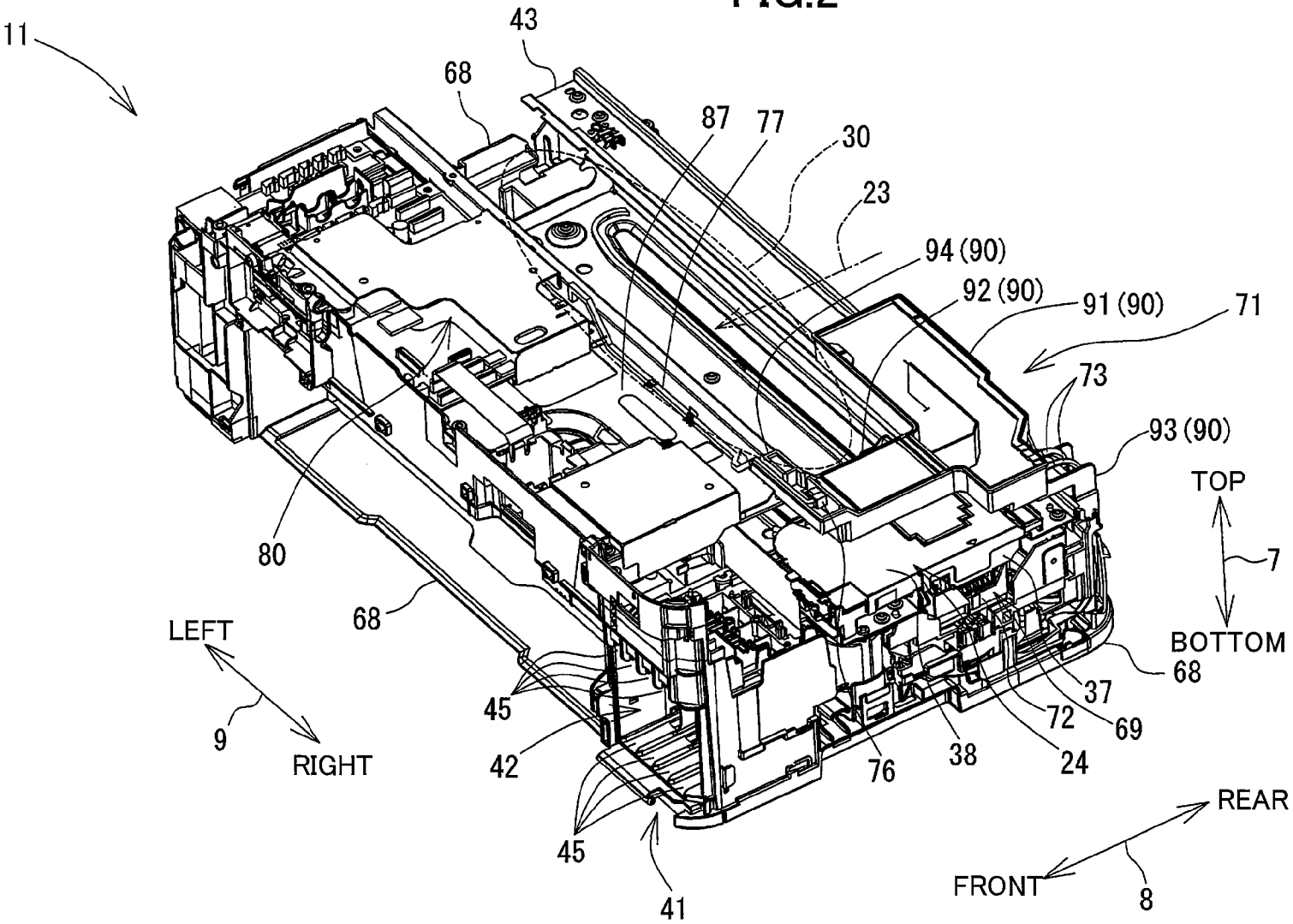
FIG. 2 is a perspective view showing an inner structure of a print section of the multifunction device as viewed from upward, rightward, and frontward.

As shown in FIGS. 2 and 3, the recording unit 24 is disposed on the conveying path 23. The recording unit 24 includes a carriage 38, and an inkjet recording head 37 mounted in the carriage 38. The carriage 38 is supported on guide rails 43 and 44 described later so as to be capable of moving in the left-right direction 9 orthogonal to the front-rear direction 8, where the front-rear direction 8 is the direction in which the recording paper is conveyed. In other words, the guide rails 43 and 44 support the carriage 38 in a manner that the carriage 38 can move along the surface of the recording paper on which an image is to be formed.

The recording head 37 is disposed on the bottom side of the carriage 38. A plurality of nozzles (not shown) is formed in the bottom surface of the recording head 37. The nozzles are exposed in the bottom of the carriage 38. Hence, the recording head 37 has a nozzle surface 36 (see FIG. 7) in which nozzles are formed.

Ink cartridges (not shown) mounted in a cartridge-mounting unit 41 described later (see FIG. 2) supply ink in each color used in the image-recording operations to the recording head 37. While the carriage 38 is sliding in the left-right direction 9, the recording head 37 selectively ejects micro-droplets of ink from the nozzles in each ink color to record an image on a sheet of recording paper conveyed along the conveying path 23.

The pair of guide rails 43 and 44 is arranged so that the guide rails 43 and 44 confront each other in the front-rear direction 8. The guide rails 43 and 44 extend along the left-right direction 9. More specifically, the guide rails 43 and 44 are mounted in a frame 68 of the print section 11 provided for supporting various components constituting the print section 11 and are thus supported by the frame 68. The carriage 38 is disposed across the guide rails 43 and 44 and is supported thereon so as to be capable of moving in the left-right direction 9.

A drive pulley (not shown), a follow pulley 48 (see FIG. 3), and an endless belt 49 (see FIG. 3) disposed around the drive pulley and the follow pulley 48 are provided on the top surface of the guide rail 44. The drive pulley is disposed near the right end of the guide rail 44, and the follow pulley 48 near the left end of the guide rail 44. The endless belt 49 is looped around the drive pulley and follow pulley 48 in a taut state. A carriage motor (not shown) for driving the carriage 38 has a drive shaft that is coupled to the shaft of the drive pulley. The rotary drive force of the carriage motor is transmitted to the drive pulley, causing the drive pulley to rotate and the endless belt 49 to move in a circulating manner.

The carriage 38 is coupled at its bottom surface side to the endless belt 49. Hence, when the endless belt 49 moves in a circulating manner, the carriage 38 moves along the guide rails 43 and 44 in the left-right direction 9. Accordingly, the carriage 38 and the recording head 37 mounted on the carriage 38 both move in the left-right direction 9.

[Cartridge-Mounting Unit 41]

Figure 9:
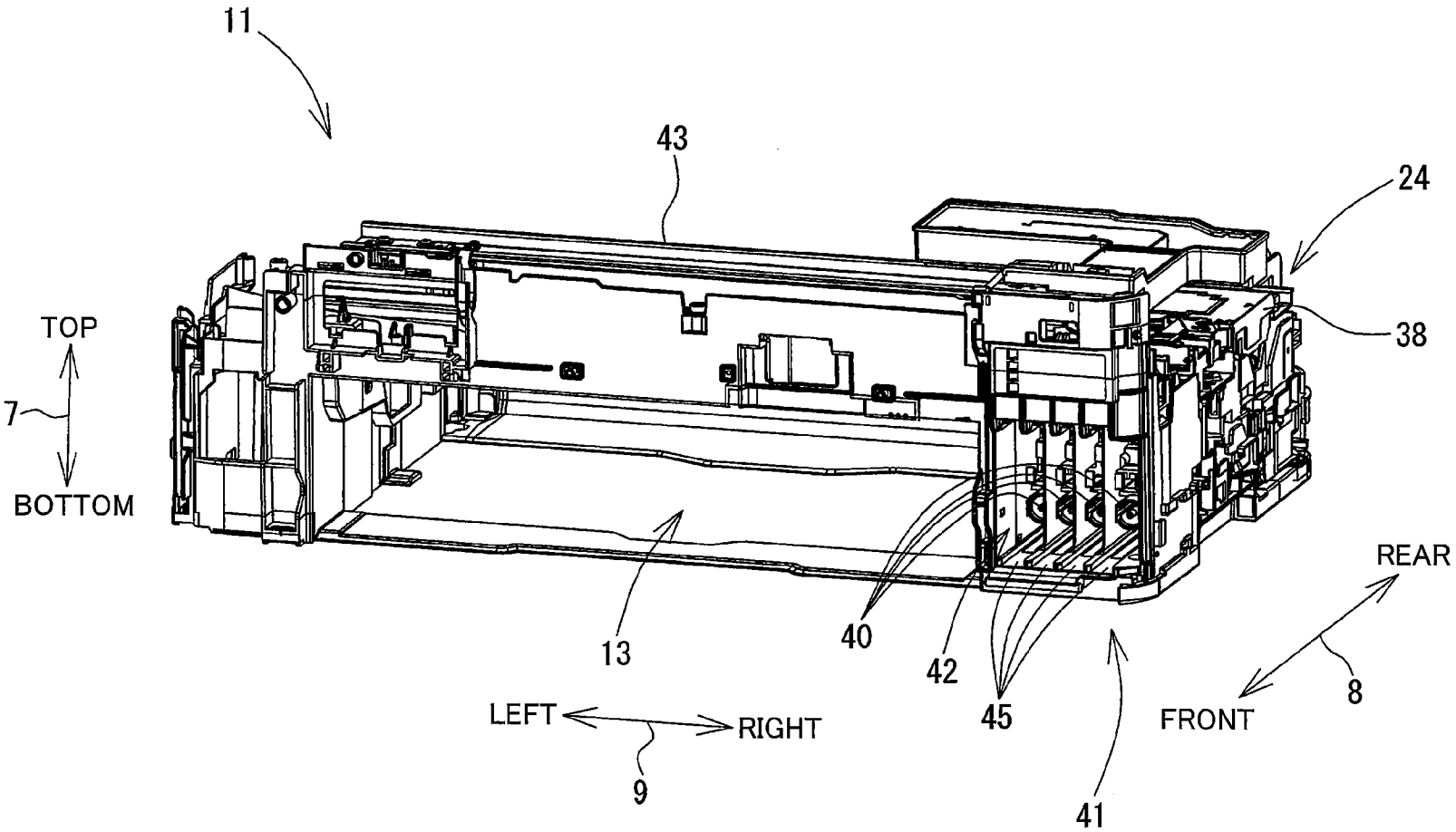
FIG. 9 is a perspective view showing the inner structure of the print section as viewed from upward, rightward, and frontward.

As shown in FIGS. 2, 3, and 9, the cartridge-mounting unit 41 is provided in the bottom right section of the print section 11 near the front surface 52 of the printer case 14. Ink cartridges are detachably inserted into the cartridge-mounting unit 41.

Each of the ink cartridges has a generally rectangular parallelepiped shape. More specifically, the ink cartridges have a flattened rectangular parallelepiped shape, with a narrow width dimension and larger height and depth dimensions.

Each of the ink cartridges has an ink chamber formed as an internal space. The ink chamber serves to store ink. When an ink cartridge is inserted into the cartridge-mounting unit 41, the ink cartridge is oriented with its width dimension aligned in the left-right direction 9, its height dimension aligned in the up-down direction 7, and its depth dimension aligned in the front-rear direction 8.

While not shown in the drawings, an ink outlet is formed in the innermost wall of the ink cartridge in a cartridge insertion direction when the ink cartridge is in a mounted state. The ink outlet is linked to the ink chamber by an ink channel. A supply valve is provided for opening and closing the ink outlet.

The cartridge-mounting unit 41 is a box-like member generally shaped like a rectangular parallelepiped, with an opening 42 formed on one side. As shown in FIGS. 2 and 9, the cartridge-mounting unit 41 is mounted in the printer case 14 of the print section 11 on the right side of the device-body opening 13 such that the opening 42 faces forward.

Ink cartridges are inserted into and removed from the cartridge-mounting unit 41 through the opening 42. Guide grooves 45 are formed in both the top and bottom surfaces of the cartridge-mounting unit 41 for guiding the ink cartridges as the cartridges are inserted into and removed from the cartridge-mounting unit 41. In the preferred embodiment, four of the guide grooves 45 are formed in each of the top and bottom surfaces of the cartridge-mounting unit 41 for removably inserting four ink cartridges provided with ink in the respective colors cyan, magenta, yellow, and black.

Ink needles 40 (see FIG. 9) are provided on the inner surface of the rear wall constituting the cartridge-mounting unit 41. The ink needles 40 are disposed at positions on the inner surface of the rear wall corresponding to the positions of the ink outlets formed in the ink cartridges when the cartridges are mounted in the cartridge-mounting unit 41.

Each of the ink needles 40 is connected to an ink tube (not shown) on the outer side of the wall forming the inner surface of the cartridge-mounting unit 41. Each of the ink tubes leads rearward from the corresponding ink needle 40 and is coupled at the other end to the recording head 37 of the recording unit 24.

When the ink cartridges are mounted in the cartridge-mounting unit 41, the corresponding ink needles 40 provided on the cartridge-mounting unit 41 are inserted through the corresponding ink outlets and open the corresponding supply valves. Accordingly, ink stored in the ink chambers of the cartridges flows through the ink channels into the ink needles 40, passes through the ink tubes, and is supplied to the recording head 37 of the recording unit 24.

As shown in FIG. 1, a cover part 47 is attached to the outer side of the cartridge-mounting unit 41 on the printer case 14 and is capable of rotating about an axis near the bottom edge of the cartridge-mounting unit 41 along a direction indicated by the arrow 46. The cover part 47 can be rotated between an open position in which the cartridge-mounting unit 41 is exposed, and a closed position in which the cartridge-mounting unit 41 is covered.

[Purge Mechanism 69]

Figure 7:
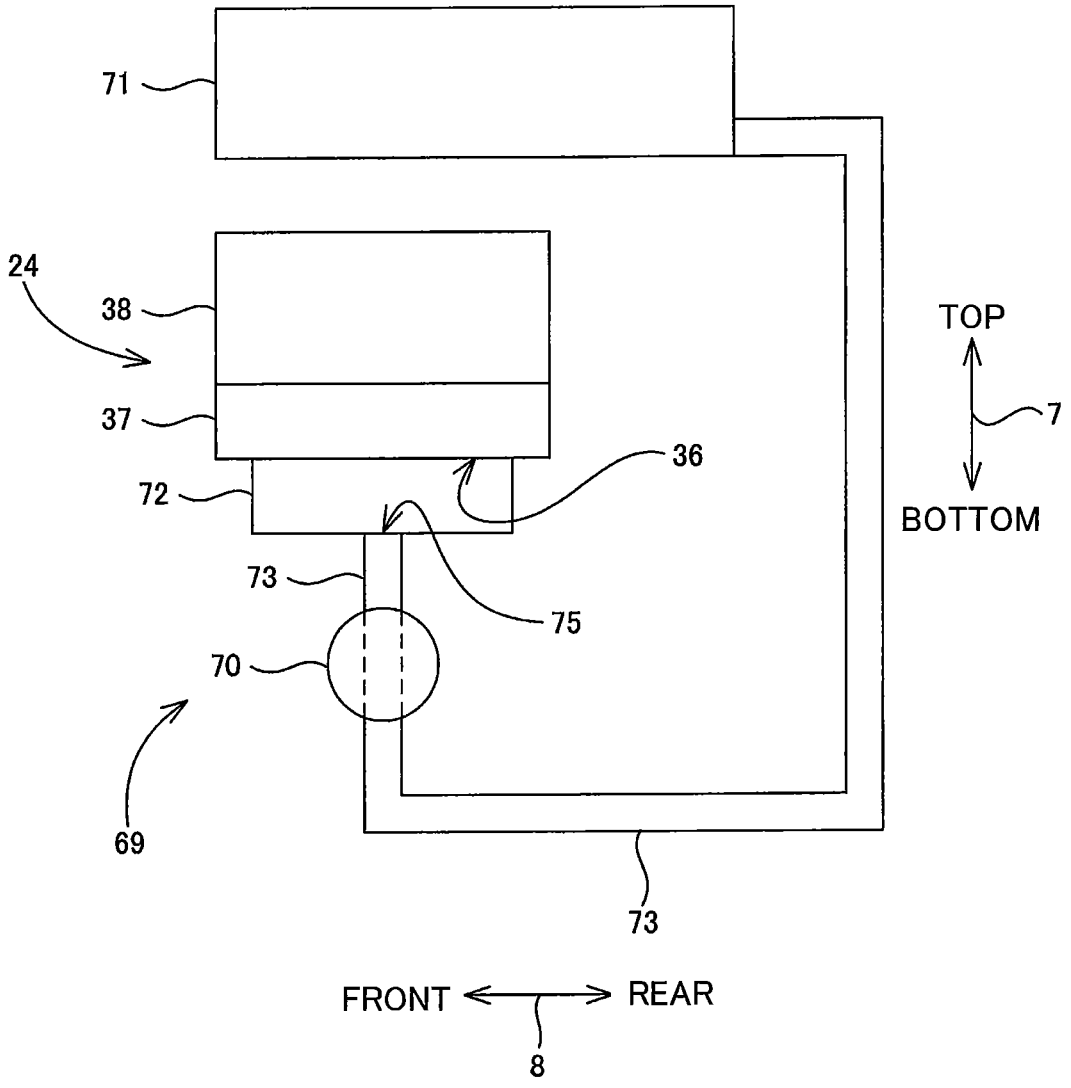
FIG. 7 is a schematic right side view showing the waste liquid chamber, a recording section, and a purge mechanism in the multifunction device.

A purge mechanism 69 is provided in the printer case 14 as shown in FIGS. 2, 3, and 7, and is adapted to draw ink together with air bubbles and foreign materials from the recording head 37. The purge mechanism 69 includes a cap 72 covering the nozzles of the recording head 37, a pump 70 connected to the cap 72 for drawing ink from the recording head 37, a lift-up mechanism 74 (FIGS. 8A and 8B) that moves the cap 72 in the up-down direction 7 so as to be in contact with and away from the recording head 37, and a pump tube 73 for connecting the pump 70 with a waste liquid chamber 71 described later.

[Cap 72]

The cap 72 is disposed offset from a recording paper passage region in the conveying path 23 in the left-right direction 9, i.e., the cap 72 is disposed at a retreated position away from the reciprocally movable range of the carriage 38. FIG. 3 shows a state where the carriage 38 is positioned at the retreated position. The cap 72 is in confrontation with the recording unit 24 when the carriage 38 is moved to the retreated position.

The cap 72 is made of elastic materials such as rubber. The cap 72 is adapted to be in hermetical contact with the nozzle surface 36 by the lift-up mechanism 74 to form a gap therebetween and cover the nozzles. The cap 72 has a bottom surface formed with a suction hole 75 connected to the pump 70 and the waste liquid chamber 71 via the pump tube 73.

[Pump 70]

The pump 70 is in fluid communication with the cap 72 via the pump tube 73. The pump 70 is a rotary type tube pump. In the embodiment, the pump 70 includes a casing having an inner wall and a rotation roller rolling along the inner wall. The pump tube 73 is disposed between the rotation roller and the inner wall. Upon rotating the rotation roller, the ink in the pump tube 73 flows from an upstream side (cap 72) to a downstream side (waste liquid chamber 71) in an ink flowing direction.

[Lift-Up Mechanism 74]

The lift-up mechanism 74 is provided with a first frame 56, a second frame 57, and a slide cam 60 as shown in FIG. 8. The depiction of the lift-up mechanism 74 is omitted in the drawings other than FIG. 8. The lift-up mechanism 74 is not limited to the following configuration as long as the lift-up mechanism 74 vertically lifts up the cap 72.

The first frame 56 has a box shape slidably supported on the slide cam 60. The slide cam 60 is supported on the second frame 57. The second frame 57 is fixed to the frame 68, or may be a part of the frame 68. The slide cam 60 has a guide surface with which a bottom surface of the first frame 56 is slidingly contatctable. The guide surface includes a first guide surface 111 disposed at a lower position, a second guide surface 112 disposed at a higher position, and a slope surface 113 connecting the first guide surface 111 with the second guide surface 112.

The first frame 56 is slidingly movable in the left-right direction 9 while being supported on the first guide surface 111, the second guide surface 112, and the slope surface 113. The first frame 56 slidingly moves in the left-right direction 9 and simultaneously moves in the up-down direction 7 by means of a support of the slope surface 113.

The first frame 56 has a right end portion provided with a lever 58 upstanding from a bottom surface thereof. The lever 58 has a top end portion overlapped with a moving region of the carriage 38.

Figures 8A, 8B:
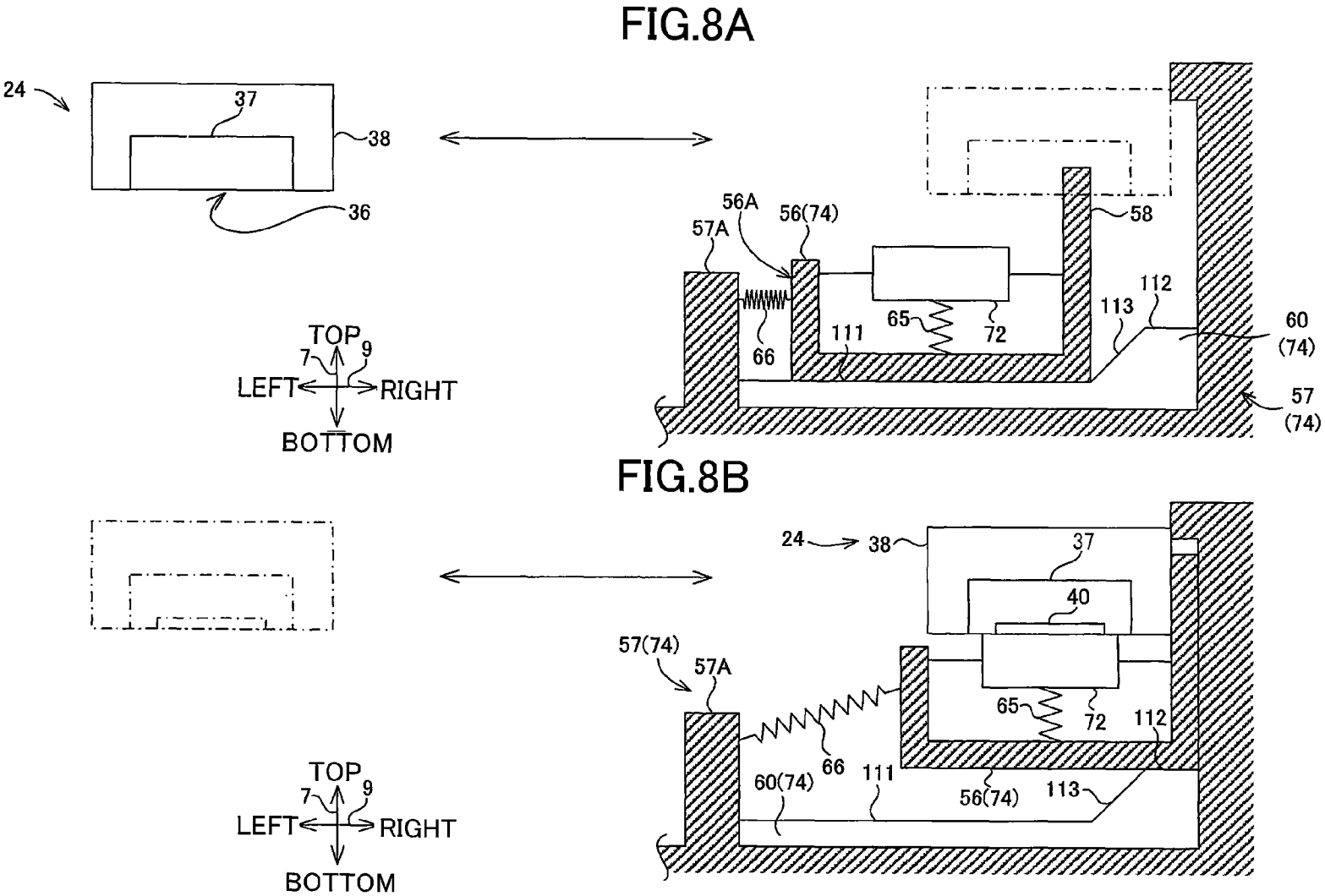
FIG. 8A is a schematic cross-sectional view showing a lift-up mechanism of the multifunction device when a cap is at a fourth posture in the multifunction device.
FIG. 8B is a schematic cross-sectional view showing the lift-up mechanism when the cap is at a third posture in the multifunction device.

The cap 72 covers the nozzle of the recording head 37 disposed at a position, as depicted by chain-line in FIG. 8A, immediately above the purge mechanism 69 (FIG. 8B). In the embodiment, the cap 72 is supported on the first frame 56 and resiliently movable in the up-down direction 7 via a first coil spring 65 disposed between an inner bottom surface of the first frame 56 and the bottom surface of the cap 72.

Upon being supported on the first guide surface 111, the cap 72 has a second posture in which the nozzle surface 36 of the recording head 37 separates from the cap 72 as shown in FIG. 8A. Upon being supported on the second guide surface 112, the cap 72 has a first posture in which the nozzle surface 36 of the recording head 37 is in contact with and covered with the cap 72 as shown in FIG. 8B. Thus, the cap is movable between the first posture and the second posture.

The second frame 57 is provided with a protrusion 57A protruding upward. A second coil spring 66 is interposed between a left surface 56A of the first frame 56 and the protrusion 57A. The second coil spring 66 is at its natural length when the first frame 56 is supported on the first guide surface 111, i.e., the cap 72 has the second posture as shown in FIG. 8A, whereas the second coil spring 66 is at its extending state when the first frame 56 is supported on the second guide surface 112, i.e., the cap 72 has the first posture as shown in FIG. 8B. That is, the second coil spring 66 is a tension spring that resiliently urges the cap 72 toward the first posture.

In the state shown in FIG. 8A, the carriage 38 reciprocally moves to the purge mechanism 69 side (rightward) and then is brought into contact with the lever 58 to push the lever 58 rightward. Thus, the first frame 56 slidingly moves rightward against a resilient force of the second coil spring 66.

The first frame 56 is moved along the guide surface and displaced diagonally rightward and upward, while the first frame 56 is supported successively on the first guide surface 111, on the slope surface 113, and then on the second guide surface 112 in this order, so that the cap 72 changes its posture from the second posture to the first posture.

[Drawing Ink]

An ink drawing (suction) procedure executed by the purge mechanism 69 will be described. As shown in FIGS. 8A and 8B, the cap 72 changes its posture from the second posture to the first posture by means of the lift-up mechanism 74. Then, the recording head 37 is covered with the cap 72. Next, the pump 70 is activated for drawing ink from the nozzles through the gap between the nozzle surface 36 and the cap 72. Consequently, the ink drawn by the pump 70 flows to the waste liquid chamber 71 via the pump tube 73.

[Waste Liquid Chamber 71]

The waste liquid chamber 71 functions to collect ink drawn out of the nozzles by the pump 70.

Figure 4:
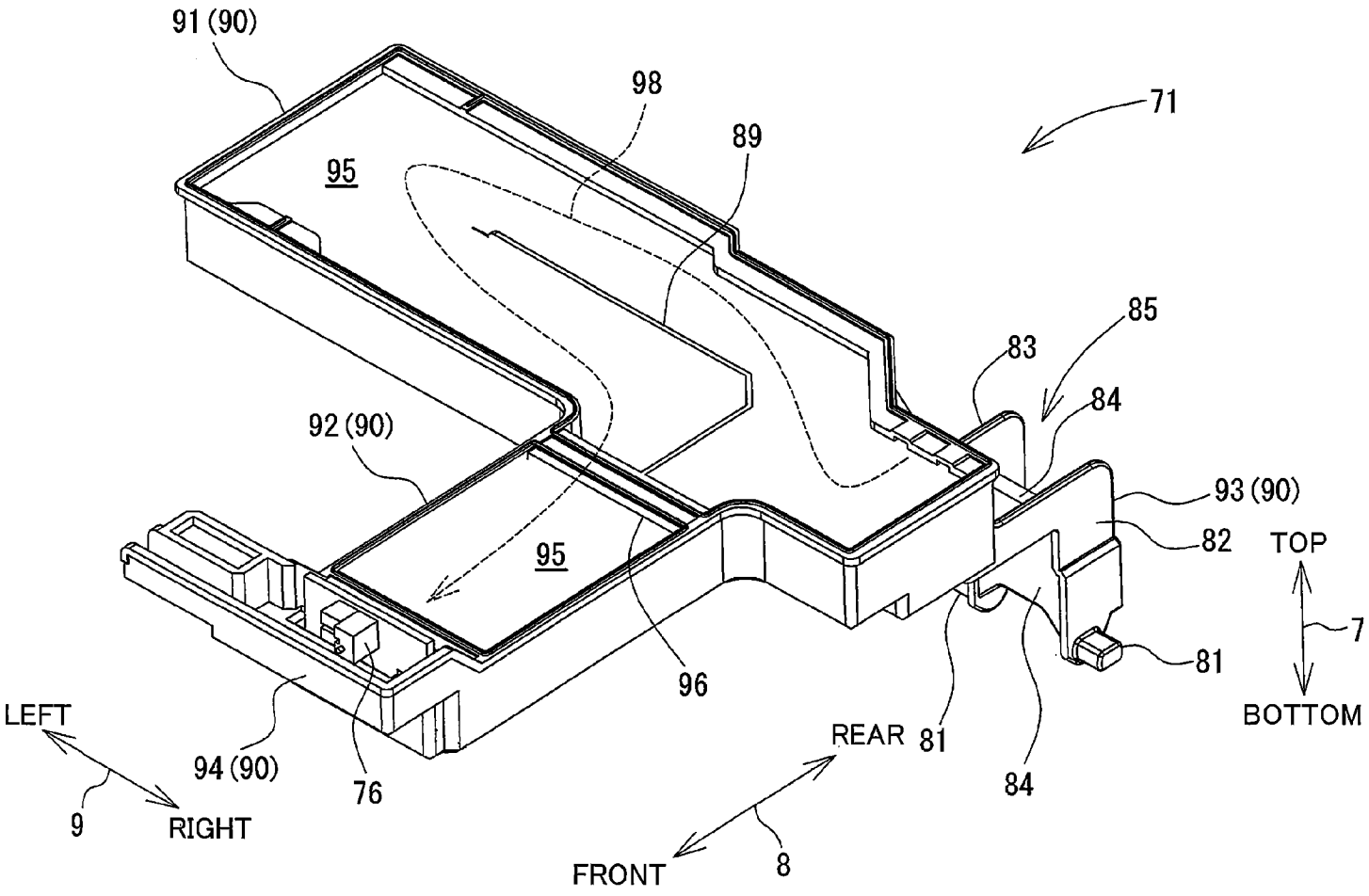
FIG. 4 is a perspective view showing a waste liquid chamber as viewed from a fourth main body side.

As shown in FIG. 4, the waste liquid chamber 71 includes a main body 90, and an ink-absorbing member 95 mounted on the main body 90.

Figure 5:
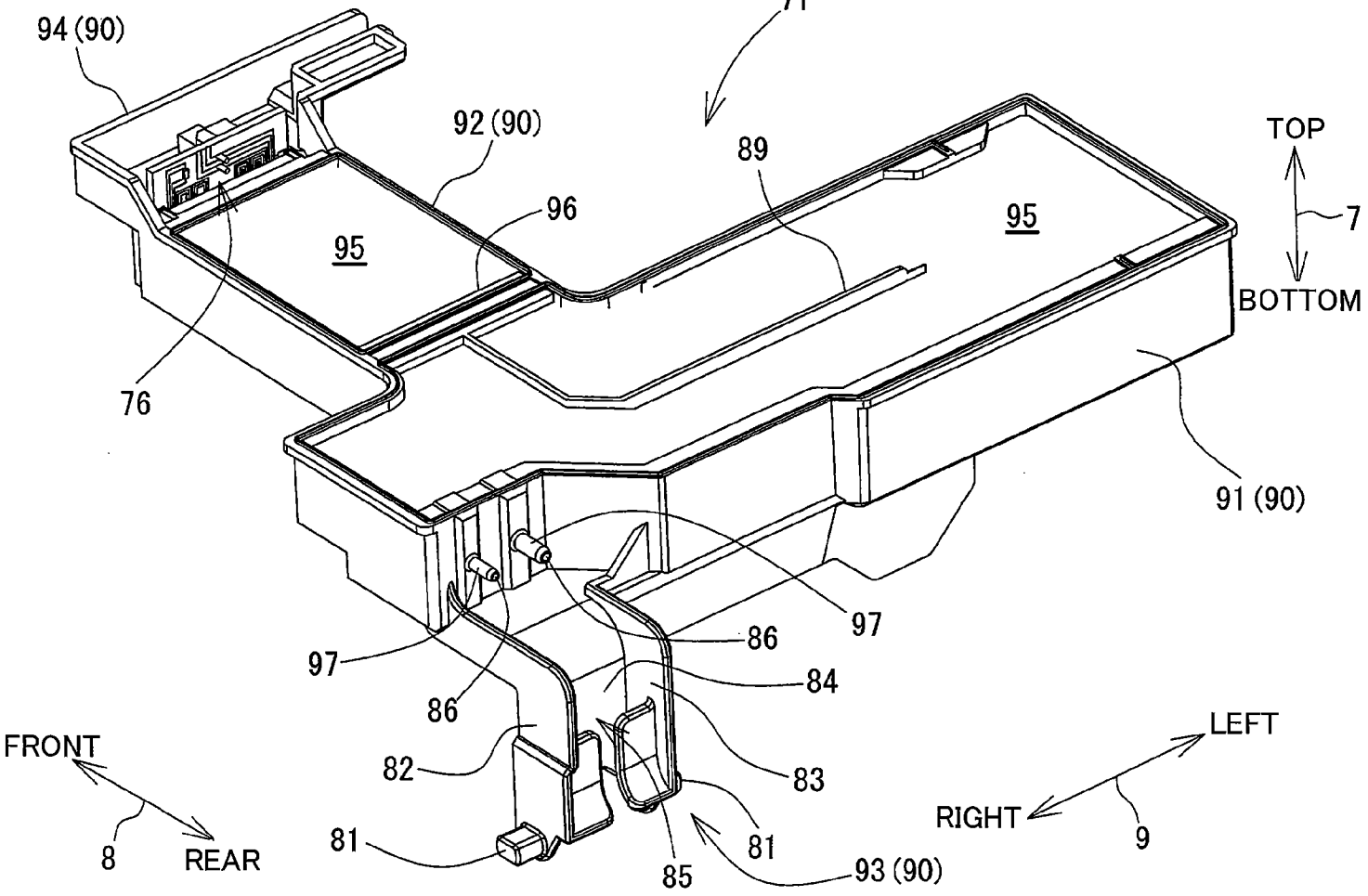
FIG. 5 is a perspective view showing the waste liquid chamber as viewed from a third main body side.

As shown in FIGS. 4 and 5, the main body 90 has a general T-shape in a plan view. The main body 90 includes a first main body part 91 that is elongated in the left-right direction 9 and constitutes the horizontal portion of the T-shape; a second main body part 92 elongated in the front-rear direction 8 and extending forward from the center portion of the first main body part 91 so as to form the vertical portion of the T-shape; a third main body part 93 formed on the opposite side of the first main body part 91 from the second main body part 92 (i.e., the rear edge); and a fourth main body part 94 formed on the opposite side of the second main body part 92 from the first main body part 91 (i.e., the front edge). The configuration of the main body parts 91-94 will be described later.

As will be described later, the waste liquid chamber 71 is rotatably supported at its rear end by the frame 68 of the print section 11 and is supported at its front end by a metal shielding plate 87.

[Layout of the Waste Liquid Chamber 71]

As shown in FIGS. 2 and 3, the frame 68 and the shielding plate 87 support the waste liquid chamber 71 so that the first main body part 91 of the waste liquid chamber 71 is disposed above the guide rail 43. That is, the first main body part 91 is placed above the space in which the guide rail 43 is disposed.

While the first main body part 91 of the waste liquid chamber 71 is disposed above the space in which the guide rail 43 is disposed in the preferred embodiment, the waste liquid chamber 71 may be laid out so that the first main body part 91 is arranged above the space in which the guide rail 44 is disposed instead. Further, the portion of the waste liquid chamber 71 disposed above this space is not limited to the first main body part 91. For example, the second main body part 92 may be disposed above this space, or both the first main body part 91 and second main body part 92 may be disposed above the space. In other words, the frame 68 and the shielding plate 87 support the waste liquid chamber 71 so that at least a part of the waste liquid chamber 71 confronts the guide rails 43 and 44.

As shown in FIGS. 2 and 3, the second main body part 92 is disposed above the purging mechanism 69 and confronts the same. The waste liquid chamber 71 is also positioned above the recording unit 24. Hence, when the carriage 38 is moved to a position opposing the purging mechanism 69, the second main body part 92 of the waste liquid chamber 71 is above the recording head 37 and confronts the same. Therefore, the frame 68 and the shielding plate 87 support the waste liquid chamber 71 so that the waste liquid chamber 71 is positioned higher than the nozzle surface 36 of the recording head 37 in the up-down direction.

In the preferred embodiment, the second main body part 92 of the waste liquid chamber 71 is disposed at a position vertically confronting the recording head 37, but the portion of the waste liquid chamber 71 disposed above the recording head 37 is not limited to the second main body part 92. For example, the first main body part 91 may be disposed above the recording head 37, or both the first main body part 91 and the second main body part 92 may be positioned above the recording head 37. Further, it is not necessary for the entire waste liquid chamber 71 to be positioned above the recording head 37, provided that at least the members of the recording head 37 functioning to collect waste liquid (the first main body part 91 and second main body part 92, for example) are positioned above the nozzle surface 36 or the recording head 37 in the up-down direction.

As described above, the frame 68 and the shielding plate 87 support the waste liquid chamber 71 so that at least a part of the waste liquid chamber 71 confronts the recording head 37, i.e., at least the part of the waste liquid chamber 71 is overlapped with the recording head 37 in plan view. The frame 68 and the shielding plate 87 also support the waste liquid chamber 71 so that at least a part of the waste liquid chamber 71 opposes the recording head 37 when the cap 72 covers the nozzle surface 36.

The waste liquid chamber 71 is also positioned higher than the ink needles 40 described above. In the preferred embodiment, the waste liquid chamber 71 is also disposed farther rearward than the ink needles 40. Therefore, the ink tubes connecting the ink needles 40 to the recording head 37 extend rearward and upward from the ink needles 40 toward the recording head 37.

As shown in FIG. 2, the frame 68 and the shielding plate 87 support the waste liquid chamber 71 so that the waste liquid chamber 71 does not overlap an open space above a region 30 indicated by a dotted line in FIG. 2. This open space will be described next.

As shown in FIG. 2, in a plan view the carriage 38 can move from its position shown in FIG. 2 (on the right side of the right edge of the region 30) to a position at the left edge of the region 30. In a plan view, the left and right edges of the region 30 shown in FIG. 2 correspond to the left and right edges of recording paper that passes through the conveying path 23. Hence, in a plan view the region 30 is a region through which the recording paper passes and the carriage 38 reciprocates. As described above, the open space is a space above the region 30. As shown in FIG. 2, no components are laid out in the open space, enabling the region 30 to be viewed from above. In other words, the open space provides an opening above the region 30 for exposing the same.

The second main body part 92 of the waste liquid chamber 71 is provided in a position opposing the region 30 in the front-rear direction 8. Here, the second main body part 92 is disposed to the right of the right edge of the region 30 and, hence, does not overlap the open space. As described above, the frame 68 and the shielding plate 87 support the waste liquid chamber 71 so that the waste liquid chamber 71 does not overlap the open space.

[Structure of the Waste Liquid Chamber 71]

Next, the structure of the waste liquid chamber 71 will be described with reference to FIGS. 4 and 5. In the following description, the up-down direction 7, front-rear direction 8, and left-right direction 9 are used to describe the layout of the waste liquid chamber 71 as shown in FIGS. 2 and 3.

As shown in FIGS. 4 and 5, the first main body part 91 and the second main body part 92 are each box-like members that are open on the top. The ink-absorbing member 95 is inserted into the internal space of the first main body part 91 and second main body part 92 through the open top thereof. The ink-absorbing member 95 is formed of a porous material, such as expanded polyurethane foam. Ink is absorbed in the ink-absorbing member 95 by entering holes formed in the porous material.

A bent plate 89 is erected from the bottom surface of the first main body part 91. The bent plate 89 extends rearward from a point near the border with the second main body part 92, then bends leftward at substantially the center of the first main body part 91 with respect to the front-rear direction 8.

A bridging plate 96 extending in the left-right direction 9 is provided near the border between the first main body part 91 and the second main body part 92. The bridging plate 96 is connected to the bent plate 89. The bridging plate 96 is provided only near the top edges of the first main body part 91 and the second main body part 92 in an area left of the connecting point at which the bridging plate 96 connects to the bent plate 89. With this structure, the first main body part 91 and second main body part 92 are in communication with each other left of the connecting point.

However, on the right side of the connecting point between the bridging plate 96 and the bent plate 89, the bridging plate 96 has a wall plate extending from the top edges of the first main body part 91 and the second main body part 92 to the bottom edges of the same. Hence, the first main body part 91 and the second main body part 92 are not in communication right of the connecting point.

With this construction, ink enters the waste liquid chamber 71 through coupling parts 97 (see FIG. 5) coupled to the pump tube 73, as will be described later, and is absorbed in the ink-absorbing member 95. Ink absorbed in the ink-absorbing member 95 is diffused therein along a flow path indicated by a dashed arrow 98 in FIG. 4, which path leads to the front end of the second main body part 92.

The third main body part 93 protrudes rearward from the rear surface of the first main body part 91 on the right end thereof, and subsequently bends and extends downward. The third main body part 93 includes a right plate 82, a left plate 83, and a bottom plate 84. The plates 82, 83, and 84 define a groove 85 in the third main body part 93.

Protrusions 81 are formed on the distal end of the third main body part 93, with one on each of the right plate 82 and the left plate 83. The protrusion 81 formed on the right plate 82 protrudes rightward, while the protrusion 81 formed on the left plate 83 protrudes leftward. The protrusions 81 are inserted into holes (not shown) formed in the frame 68 of the print section 11, enabling the waste liquid chamber 71 to pivotally move, as will be described later.

The fourth main body part 94 is provided on the front surface of the second main body part 92. The fourth main body part 94A includes a sensing electrode 76 described later.

[Layout of the Pump Tube 73 for the Waste Liquid Chamber 71]

As illustrated in FIG. 7, the pump tube 73 extends downward from the suction hole 75 formed in the bottom of the cap 72, then bends near the bottom surface of the print section 11 and extends rearwardly along the bottom surface. Subsequently, the pump tube 73 again bends in the area directly below the third main body part 93 positioned on the rear edge of the waste liquid chamber 71 and extends upwardly along the rear surface of the print section 11. Finally, the pump tube 73 runs along the groove 85 of the fourth main body part 94 and connects to the coupling parts 97. As shown in FIG. 5, the groove 85 is formed in a space on and near a line extending between the protrusions 81 in the direction that the protrusions 81 protrude (the left-right direction 9). Hence, the pump tube 73 passes at a position adjacent to the axes of the protrusions 81, which are identical to the rotational axis of the waste liquid chamber 71.

As shown in FIG. 5, the coupling parts 97 are provided on the rear surface of the first main body part 91 above the region in which the third main body part 93 protrudes therefrom. In other words, the coupling parts 97 are provided on the rear side of the waste liquid chamber 71, i.e., the side on which the protrusions 81 of the waste liquid chamber 71 are provided. In the preferred embodiment, the coupling parts 97 include two protrusions that protrude rearward from the rear surface of the first main body part 91. A hole 86 is provided in each coupling parts 97. The holes 86 penetrate the coupling parts 97 and communicate with the interior space of the first main body part 91. The pump tube 73 is connected to the coupling parts 97. With this configuration, the pump 70 can draw in ink from the nozzles provided in the recording head 37 and can force the ink into the waste liquid chamber 71 through the pump tube 73. Thus, the coupling parts 97 serve to connect the waste liquid chamber 71 to the pump tube 73.

Since the pump tube 73 is arranged so as to passes at a position adjacent to the rotational axis of the waste liquid chamber 71, the length of the pump tube 73 from its position at the rotational axis to the coupling parts 97 does not change when the waste liquid chamber 71 pivotally moves in the following description. In addition, the length of the pump tube 73 from the point at the rotational axis to the pump 70 does not change when the waste liquid chamber 71 pivotally moves. Hence, the pump tube 73 will not come off the coupling parts 97 and will not come off the pump 70 while the waste liquid chamber 71 pivotally moves. Thus, it is unnecessary to provide a longer pump tube 73 to prevent the pump tube 73 from coming detached when the waste liquid chamber 71 pivotally moves.

[Pivotally Movement of the Waste Liquid Chamber 71]

The waste liquid chamber 71 is supported on the frame 68 of the print section 11 by inserting the protrusions 81 into holes formed in the frame 68. In this way, the protrusions 81 provided on the rear side of the waste liquid chamber 71 serve as the rotational axis, enabling the waste liquid chamber 71 to pivotally moves about the protrusions 81 so that the front side of the waste liquid chamber 71 moves vertically.

As described above, the front side of the waste liquid chamber 71 is the distal end that pivotally moves about the rear side of the waste liquid chamber 71. Similarly, the front side of the scanner case 15 is the distal end that pivotally moves about the rear side of the same. In other words, the waste liquid chamber 71 and the scanner case 15 both have rotational shaft unit of the present invention on the same side, i.e., the rear side. Therefore, the following procedure is used to replace the recording head 37. First, the user lifts and rotates the front side of the scanner case 15 upward, exposing the cover body covering the top of the print section 11. In other words, the user clears space above the waste liquid chamber 71. Next, the user removes the cover body, exposing the waste liquid chamber 71. Next, the user lifts and rotates the front side of the waste liquid chamber 71 upward, exposing the recording unit 24. Accordingly, the user can remove the carriage 38 and the recording head 37 of the recording unit 24 at this time. As described above, in the preferred embodiment the carriage 38 can be removed to facilitate replacement of the recording head 37.

Figure 6:
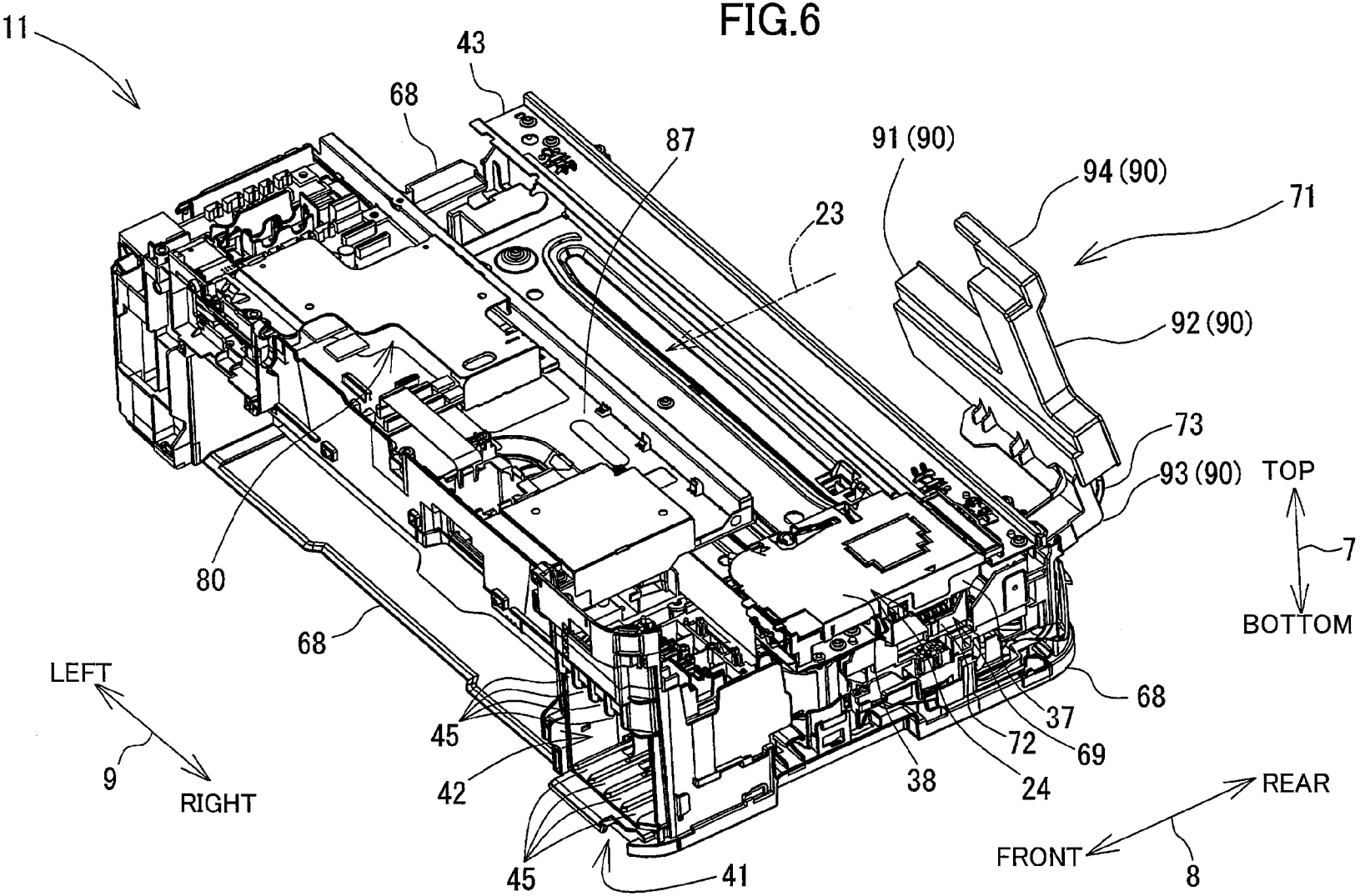
FIG. 6 is a perspective view showing the inner structure as viewed from upward, rightward, and frontward when the waste liquid chamber is at a fourth posture.

As shown in FIGS. 2 and 6, the waste liquid chamber 71 can rotate between a third posture (FIG. 2) in which the waste liquid chamber 71 can cover the tops of the carriage 38 and the recording head 37, and a fourth posture (FIG. 6) in which the waste liquid chamber 71 is retracted upward from the carriage 38 and the recording head 37, exposing the same.

When the waste liquid chamber 71 is in the third posture shown in FIG. 2, the first main body part 91 is positioned above the purging mechanism 69. With this configuration, when the carriage 38 is positioned above the purging mechanism 69, the first main body part 91 of the waste liquid chamber 71 covers the top of the recording head 37 mounted in the carriage 38. It is also possible to cover the top of the recording head 37 with a portion of the waste liquid chamber 71 other than the first main body part 91, such as the second main body part 92, third main body part 93, or fourth main body part 94.

When the waste liquid chamber 71 is in the fourth posture shown in FIG. 6, the waste liquid chamber 71 does not cover the carriage 38 and the recording head 37, regardless of where the carriage 38 is positioned.

When the waste liquid chamber 71 is in the third posture shown in FIG. 2, the left side of the fourth main body part 94 contacts the rear edge and right end portion of the shielding plate 87 mounted on the frame 68 of the print section 11 from above. With the fourth main body part 94 contacting the shielding plate 87, the waste liquid chamber 71 is restricted from rotating farther downward from the third posture shown in FIG. 3, i.e., from rotating farther toward the recording head 37.

[Circuit Board 80 and Sensing Electrode 76]

A circuit board 80 is assembled to the top of the metal shielding plate 87 described above with screws or the like. The circuit board 80 is a printed circuit board well known in the art on which electronic components and the like are mounted. The circuit board 80 is provided with a controller for controlling the operations of the multifunction device 10. The controller is configured of a microcomputer and various electronic components mounted on the circuit board 80.

As shown in FIGS. 2 and 3, the circuit board 80 is disposed at the same height as the waste liquid chamber 71 with respect to the up-down direction 7. The circuit board 80 and waste liquid chamber 71 are disposed at the same height so that the region occupied by a circuit board unit configured of the circuit board 80 and the various electronic components provided on the circuit board 80 at least partially overlaps the region occupied by the waste liquid chamber 71 in the up-down direction 7.

As shown in FIGS. 4 and 5, a sensing electrode 76 is provided on the fourth main body part 94 for detecting the presence of ink at the border between the fourth main body part 94 and the second main body part 92. The surface of the sensing electrode 76 that performs the actual sensing faces the second main body part 92, while the opposite side of the detecting surface faces the fourth main body part 94. As shown in FIG. 2, an electric wire 77 extends from the side of the sensing electrode 76 opposite the detecting surface side toward the circuit board 80. The electric wire 77 is electrically connected to the controller mounted on the circuit board 80.

The output voltage of the sensing electrode 76 differs from the time during which ink reaches the sensing electrode 76 (i.e., the time in which a large quantity of ink is stored in the waste liquid chamber 71), and the time in which ink has not reached the sensing electrode 76 (i.e., the time in which the quantity of ink stored in the waste liquid chamber 71 is low). In this way, the sensing electrode 76 detects the quantity of ink stored in the waste liquid chamber 71.

The controller mounted on the circuit board 80 determines whether ink has reached the sensing electrode 76 based on the magnitude of voltage outputted by the sensing electrode 76. When the controller determines that ink has reached the sensing electrode 76, the controller notifies the user to replace the ink-absorbing member 95 by playing a sound and displaying a message on the display panel 19 (see FIG. 1), for example. Hence, the controller controls the multifunction device 10 based on the quantity of ink stored in the waste liquid chamber 71.

Effects of the Embodiment

By providing a space above the recording head 37 within the multifunction device 10 according to the preferred embodiment, the waste liquid chamber 71 can be disposed in this space. In other words, there is no need to allocate space for the waste liquid chamber 71 on the front, rear, left, or right sides of the recording head 37. This configuration can minimize an increase in the installation area of the multifunction device 10 caused by providing the waste liquid chamber 71 in the multifunction device 10.

Further, the distance from the recording head 37 to the waste liquid chamber 71 is reduced in the preferred embodiment. This arrangement affords the use of a pump 70 having a small suction force and enables the mechanism that draws ink from the nozzles to have a simpler configuration.

Further, when recording paper becomes jammed inside the print section 11, in the preferred embodiment the recording paper can be removed through the open space without contacting the waste liquid chamber 71.

By providing a space above the guide rails 43 and 44 within the print section 11 in the preferred embodiment, the waste liquid chamber 71 can be disposed in this space. In other words, there is no need to allocate space for the waste liquid chamber 71 on the front, rear, left, or right sides of the recording head 37. This configuration can minimize an increase in the installation area of the multifunction device 10 resulting from the addition of the waste liquid chamber 71.

In the preferred embodiment, the carriage 38 and the recording head 37 can be exposed by the pivotal movement of the waste liquid chamber 71 to the fourth posture. Hence, this configuration facilitates replacement of the recording head 37.

By the pivotal movement of the scanner case 15, the waste liquid chamber 71 can be exposed to outside of the frame 68, facilitating the replacement of the recording head 37.

The rotational axis side of the waste liquid chamber 71 rotates much less than the side of the waste liquid chamber 71 opposite the rotational axis when the waste liquid chamber 71 is rotated. Therefore, in the preferred embodiment the coupling parts 97 are provided on the rotational axis side of the waste liquid chamber 71 since this side moves the least during rotation. Hence, this configuration reduces the possibility of the pump tube 73 coming off the coupling parts 97 when the waste liquid chamber 71 pivotally moves.

Further, the portion of the waste liquid chamber 71 positioned coaxially with the rotational axis of the same moves less than portions of the waste liquid chamber 71 separated from the rotational axis when the waste liquid chamber 71 pivotally moves. Accordingly, in the preferred embodiment the pump tube 73 is laid out so as to run through the rotational axis of the waste liquid chamber 71. This configuration of the embodiment reduces the potential for the pump tube 73 to come off the coupling parts 97 when the waste liquid chamber 71 is rotated.

The shielding plate 87 provided in the preferred embodiment can prevent the waste liquid chamber 71 from contacting the carriage 38, the recording head 37 mounted on the carriage 38, and the like when the waste liquid chamber 71 rotates.

In the preferred embodiment, the ink needles 40 are disposed lower than the waste liquid chamber 71. In this way, it is unlikely that ink will flow from the ink cartridge to the waste liquid chamber 71 via the recording head 37 without the use of the pump 70. Thus, even in the event that the menisci formed in the nozzles break, allowing ink to flow from the recording head 37 to the waste liquid chamber 71, the amount of ink flowing from the ink cartridge to the waste liquid chamber 71 via the recording head 37 can be minimized.

In the preferred embodiment, the circuit board 80 is disposed at the same height as the waste liquid chamber 71. That is, the circuit board 80 is positioned at the same height as the sensing electrode 76 provided on the waste liquid chamber 71. Therefore, the circuit board 80 can be disposed at a position near the sensing electrode 76, thereby reducing the amount of noise overlapping signals exchanged between the sensing electrode 76 and the circuit board 80 and reducing the potential for signals exchanged between the sensing electrode 76 and the circuit board 80 to contain noise.

Variations of the Embodiment

While the waste liquid chamber 71 in the preferred embodiment described above is configured to rotate about its rear side, the waste liquid chamber 71 may be configured to move in a manner that does not involve rotation. For example, the waste liquid chamber 71 may be detachably supported by the frame 68 of the print section 11 and the like.

While the invention has been described in detail with reference to the embodiment thereof, it would be apparent to those skilled in the art that various changes and modifications may be made therein without departing from the spirit of the invention.

What is claimed is:

1. An inkjet recording device comprising:

a recording head having a nozzle surface formed with a nozzle configured to eject ink droplets to form an image onto a recording medium;

a pump configured to draw ink from the recording head;

a waste liquid chamber configured to accommodate the ink drawn by the pump; and a first support configured to support the waste liquid chamber at a position above the nozzle surface, wherein the first support is configured to support the waste liquid chamber such that at least a first part of the waste liquid chamber is configured to vertically confront the recording head.

2. The inkjet recording device according to claim 1, wherein the at least first part of the waste liquid chamber is configured to be overlapped with the recording head in plan view.

3. The inkjet recording device according to claim 1, further comprising:

a carriage on which the recording head is mounted, the carriage being movable along the recording medium and movable to a retreated position where the carriage is out of confrontation with the recording medium; and a cap disposed in confrontation with the nozzle surface when the carriage is moved to the retreated position, the cap being movable between a first posture in which the cap covers the nozzle surface and a second posture in which the cap is spaced away from the nozzle surface, wherein the pump is in fluid communication with the cap to draw the ink from the nozzle covered by the cap, and wherein the first support is configured to support the waste liquid chamber such that the at least first part of the waste liquid chamber is in confrontation with the recording head that has been covered by the cap.

4. The inkjet recording device according to claim 3, further comprising a casing defining an open space where the carriage moves, the open space being positioned above a passage area of the recording medium and permitting the recording medium to be exposed to an outside, wherein the first support is configured to support the waste liquid chamber such that the waste liquid chamber is vertically offset from the open space.

5. The inkjet recording device according to claim 1, further comprising:

a carriage on which the recording head is mounted, the carriage being movable along the recording medium; and a second support configured to movably support the carriage;

wherein the first support is configured to support the waste liquid chamber such that at least a second part of the waste liquid chamber is in confrontation with the second support.

6. The inkjet recording device according to claim 1, wherein the first support comprises a rotational support unit configured to pivotably support the waste liquid chamber between a third posture in which the waste liquid chamber is capable of covering the recording head and a fourth posture in which an upper portion of the recording head is exposed outside.

7. The inkjet recording device according to claim 6, wherein the waste liquid chamber has one end pivotally movably connected to the rotational support unit, the inkjet recording device further comprising a tube configured to provide a fluid communication from the pump to the waste liquid chamber, and a connector disposed at the one end, and configured to connect the tube to the waste liquid chamber.

8. The inkjet recording device according to claim 7, wherein the rotational support unit has a rotational shaft, and the inkjet recording device further comprising a piping unit configured to direct the tube such that the tube passes at a position adjacent to the rotational shaft.

9. The inkjet recording device according to claim 7, further comprising a casing having a side surface confronting the rotational support unit and a bottom surface perpendicularly connected to the side surface, wherein the tube extends along the bottom surface and the side surface.

10. The inkjet recording device according to claim 6, wherein the first support comprises a restricting unit configured to prevent the waste liquid chamber from pivotally moving from the third posture toward the recording head.

11. The recording device according to claim 1, further comprising an ink supply, unit detachably receiving an ink cartridge thereinto, the ink cartridge accommodating therein an ink, the ink supply unit being formed with an ink supply hole in fluid communication with the recording head to supply the ink accommodated in the ink cartridge to the recording head, the waste liquid chamber being positioned higher than the ink supply hole.

12. The recording device according to claim 1, further comprising a detection unit provided in the waste liquid chamber and configured to detect an amount of ink therein, and a circuit board connected to the detection unit via an electric wire, the circuit board being configured to control the recording device based on the amount of the ink, the circuit board being positioned at the same height as the waste liquid chamber.

13. A multifunction device comprising:

an inkjet recording device according to claim 1; and an upper unit disposed above the waste liquid chamber and having one end portion pivotally movably connected to the inkjet recording device, wherein the waste liquid chamber has one end pivotally movably connected to the first support, and has another end, wherein the one end portion of the upper unit is positioned closer to the one end than to the another end.

* * * * *